United States Patent [19]

Müller

[11] 4,404,495

[45] Sep. 13, 1983

[54] HIGH FREQUENCY RESONATOR

[75] Inventor: Rolf W. Müller, Dreieich, Fed. Rep. of Germany

[73] Assignee: Gesellschaft für Schwerionenforschung mbH, Darmstadt, Fed. Rep. of Germany

[21] Appl. No.: 230,273

[22] Filed: Jan. 30, 1981

[30] Foreign Application Priority Data

Jan. 30, 1980 [DE] Fed. Rep. of Germany ..... 3003258

[51] Int. Cl.[3] ..... H01J 25/10

[52] U.S. Cl. ..... 315/5.41; 313/360.1; 313/361.1; 315/5.42; 328/233

[58] Field of Search ..... 315/5.41, 5.42; 328/233; 313/360.1, 361.1, 359.1

[56] References Cited

U.S. PATENT DOCUMENTS

| | | | |
|---|---|---|---|
| 3,067,358 | 12/1962 | Pottier | 315/5.42 |
| 3,402,358 | 9/1968 | Wharton | 328/233 |
| 4,181,894 | 1/1980 | Pottier | 315/5.41 |

*Primary Examiner*—Saxfield Chatmon, Jr.
*Attorney, Agent, or Firm*—Spencer & Kaye

[57] ABSTRACT

In a high frequency resonator for accelerating a beam of heavy ions in an accelerator, which resonator includes a cylindrical resonator housing having a beam inlet end via which the beam enters the housing, a beam outlet end via which the beam leaves the housing and a longitudinal axis defining a path for travel of the beam between the ends, two opposed end walls each at a respective end of the housing, and an even number of elongate, conductive current collectors disposed within the housing, extending longitudinally thereof, and spaced apart equidistantly about the beam axis, with every other collector being connected to one end wall and the intervening collectors being connected to the other end wall, the number of such collectors being at least four, each end wall is provided with a central opening surrounding the longitudinal axis of the housing, each current collector extends the full length of the housing, and each collector has two longitudinal ends one of which extends into the opening of that end wall to which that collector is connected and the other of which extends into the opening of the other end wall while being out of contact with the other end wall.

10 Claims, 2 Drawing Figures

HIGH FREQUENCY RESONATOR

BACKGROUND OF THE INVENTION

The present invention relates to a high frequency resonator for the acceleration of heavy ions in an accelerator, e.g. a heavy ion accelerator operating at low frequency, of the type having a cylindrical resonator housing whose ends are provided with walls, and an even number, equal to at least four, of elongate conducting current collectors inside the housing, the current collectors being spaced symmetrically around a beam path extending along the longitudinal axis of the housing, with every second current collector being connected, via one of its ends, to the inlet end of the housing and the intervening collectors being similarly connected to the outlet end of the housing.

The purpose of any hf resonator of an accelerator is to feed a hf voltage U at the frequency f to a quasi-periodic electrode system (hereunder "duty system") placed in a high vacuum. The duty system can be considered to behave electrically like a capacitance C' per unit length and to have an effective length 1, resulting in a capacitance of $C=C'\times 1$. Reactive currents flowing into this capacitance must be delivered by the resonator. These currents together with other capacitive reactive currents produce a magnetic field H and a corresponding magnetic flux $\Phi$ which in turn generates, by its variation as a function of time, the voltage U. This will be described later with reference to FIG. 1.

This process is not free of energy dissipation. An effective hf power has to be supplied to the resonator via a feeding device to generate a voltage $U_1$ on a supply line having a matched wave impedance Z. Generally, in the direction of the supply line there will be a vacuum window.

Such a resonator may also be considered as a resonance transformer having a voltage transmission ratio $U/U_1$. The transmission energy loss $P_V$ can be defined as $P_V=U^2/2R_p$, where $R_p$ is the resonance resistance. Transmission ratio and resonance resistance are in general indefinite quantities, since one only rarely succeeds in generating a sufficiently homogeneous voltage distribution at the duty system.

A hf resonator of the type described above is known in the art, but presents several disadvantages.

SUMMARY OF THE INVENTION

It is an object of the present invention to improve a high frequency resonator of the type described above with respect to several of its properties.

A more specific object of the invention is to make possible the application of high voltages together with low hf frequencies of between 10 and 30 MHz, necessary for the acceleration of very heavy ions (atomic mass/charge $\geqq 100$), with current intensities of a few milliamperes and more, while maintaining small dimensions for the resonator and achieving a highly efficient power utilization.

Another specific object of the invention is to provide a resonator which achieves a system voltage along the electrode system from the beginning to the end which is as constant as possible, that is a "flat voltage". This will facilitate the application of RFQ focussing.

It is yet another object of the present invention to provide an inducing magnetic field with essentially only azimuthal, or tangential, components.

These and other objects are achieved, according to the invention, in a high frequency resonator for accelerating a beam of heavy ions in an accelerator, which resonator includes a cylindrical resonator housing having a beam inlet end via which the beam enters the housing, a beam outlet end via which the beam leaves the housing and a longitudinal axis defining a path for travel of the beam between the ends, means defining two opposed end walls each at a respective end of the housing, and an even number of elongate, conductive current collectors disposed within the housing, extending longitudinally thereof, and spaced apart equidistantly about the beam axis, with every other collector being connected to one end wall and the intervening collectors being connected to the other end wall, the number of such collectors being at least four, by providing:

each end wall with a central opening surrounding the longitudinal axis of the housing, dimensioning each current collector to extend the full length of the housing, and providing each collector with two longitudinal ends one of which extends into the opening of that end wall to which that collector is connected and the other of which extends into the opening of the other end wall while being out of contact with the other end wall.

According to preferred embodiments of the invention, the current collectors are given a tapering form from their mounting point to their ends in a lance tip like shape, or are sharpened at their end, and the current collectors, over their length with respect to the beam, are shaped in a roof-like, or vaulted, structure.

According to another advantageous feature of the invention, the ends or peaks of the current collectors project freely into further recesses of the openings in the walls. Those recesses are interspaced, in the circumferential direction of the housing, alternately between the mounting points of the neighboring counter-operating current collectors.

According to another feature of this invention, disc-like drift tubes serving as electrodes are conductively mounted to the current collectors in a well-known manner, every other one of the drift tubes being connected to the one half of the current collectors and the remaining, or intervening, drift tubes being connected to the other half, by means of electrode connectors.

In preferred embodiments of structure of this latter type, beam focussing elements are carried by the drift tubes and surround the beam axis. Preferably, these focussing elements are composed of two pairs of focussing fingers carried by each drift tube and each extending parallel to the beam axis, with each pair of fingers projecting toward a respective immediately adjacent drift tube and the fingers of each pair being located diametrically opposite one another relative to the beam axis, and the fingers carried by each drift tube are angularly offset by 90° about the beam axis relative to the fingers carried by the immediately adjacent drift tube. In addition, in such preferred embodiments, the opening in each respective drift tube includes a plurality of recesses each axially aligned with a respective finger projecting toward the respective drift tube from an immediately adjacent drift tube, and each finger has a tapered end extending into that recess with which the finger is axially aligned while being out of contact with that drift tube toward which the finger projects.

Some of the advantages of this invention are: an almost perfect equidistribution of the voltage U, even if the capacity coating of the duty system is not entirely uniform; and a minimum of transmission losses and an optimum resonance resistance, achieved by an improved and homogeneously stabilized current density distribution. Furthermore, the inducing magnetic field exhibits essentially only azimuthal, or tangential, components. The openings or break-throughs in the end wall of the resonator provide a simple and advantageous possibility for a mechanical and electric coupling to neighboring resonators. The invention opens the way to systems of closely coupled resonators built up out of several single resonators, thus forming a linear accelerator of appropriate length.

DESCRIPTION OF THE PREFERRED EMBODIMENTS

Figure 1:
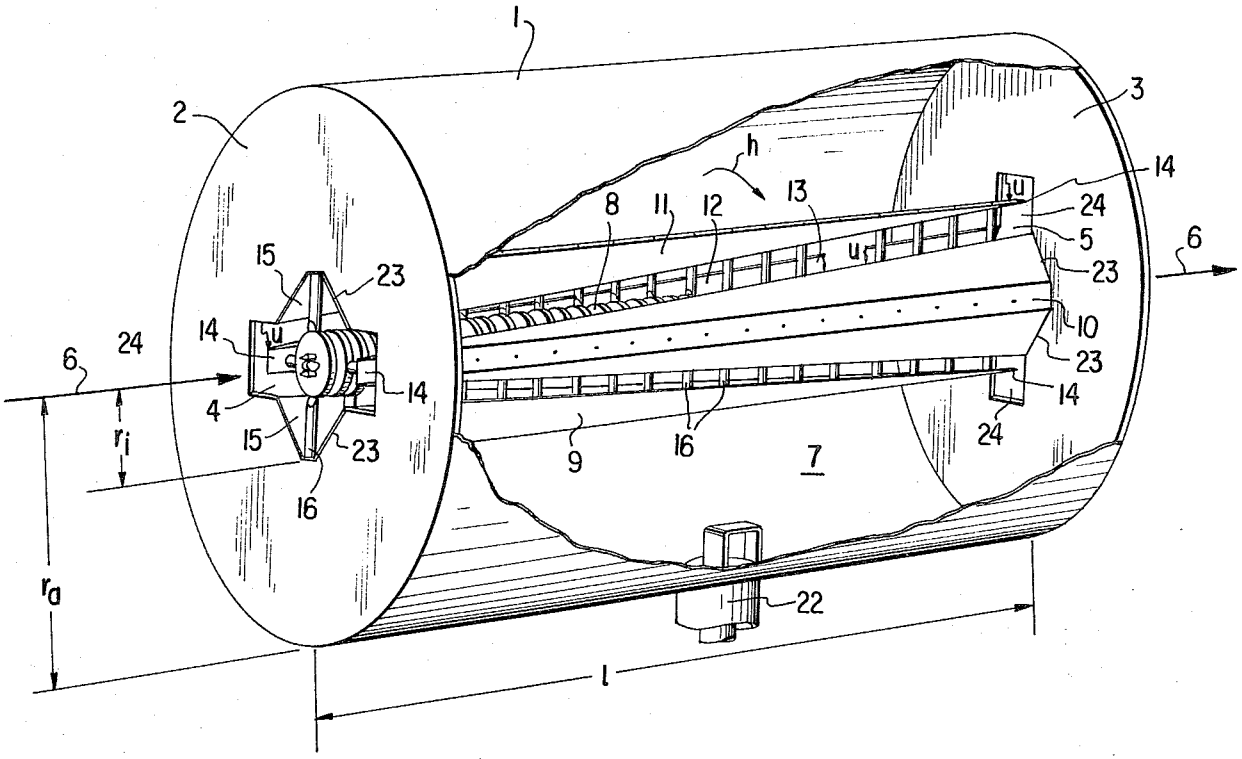
FIG. 1 is a pictorial perspective view of a preferred embodiment of a resonator according to the invention.

The resonator shown in FIG. 1 includes a cylindrical sheet metal housing 1 provided at its axial ends with electrically conducting end walls 2 and 3 each having a central opening 4 or 5, respectively, for the passage of a heavy ion beam 6. The interior 7 of the housing 1 is maintained under a vacuum. Wall 2 and opening 4 are here located at the inlet side for beam 6 and wall 3 with opening 5 are at the beam outlet side. The lower part of the housing 1 is provided with a conventional magnetically coupled feeding device 22.

The longitudinal axis of the housing 1 defines the path of beam 6 and is surrounding by a duty system, or electrodes 8. A system of current collectors 9, 10, 11 and 12 is disposed around system 8. Each current collector is an elongate member which extends parallel to the axis of housing 1 and is tapered in the longitudinal direction. Each collector is mounted to a respective wall 2 or 3 in an electrically conducting manner and decreases in width with increasing distance from its mounting point in wall 2 or 3 to the same extent as the current collected by that collector from the electrodes, or the duty system, decreases so that the current density on the surface of the current collectors becomes approximately uniform.

Each current collector 9, 10, 11 and 12 extends over the entire length of housing 1 and ends at a peak or tip 14 projecting into the plane of the end walls 2 or 3 which it does not contact. There is an even number of current collectors, with two neighboring current collectors, e.g. 9 and 10 or 11 and 12, being connected to respectively different end walls 2 and 3, operating counter to one another, and forming a gap 13 of constant width between themselves. For the number of current collectors, any even number greater than or equal to four is possible. In the embodiment described here, a total number of four current collectors was chosen, that is two for either direction, because mutual strutting is then procured by the electrodes of the duty system 8, resulting in a very rigid, mechanically and statically advantageous structure. It is also possible for the number of current collectors to be six, eight, or more.

In the illustrated embodiment, each collector has a generally roof-like structure such that its cross section in a plane perpendicular to the longitudinal axis of the housing 1 has the form of the short base and sides of a trapezoid. The short base of such trapezoid is substantially perpendicular to a plane containing the housing longitudinal axis.

Each current collector is connected via its wide end to its associated end wall and, as already mentioned, every successive current collector is connected to a respectively different end wall, e.g., in the representation of FIG. 1, current collectors 9 and 11 are connected to wall 2, and current collectors 10 and 12 are connected to wall 3. So one half of the current collectors are mounted to one wall and the other half to the other wall.

This mounting is effected in recesses 15 situated at the borders of the central beam passage openings 4 and 5 of the walls 2 and 3. The profile of each current collector 9 to 12 at its mounting point corresponds to the profile of the associated recess 15 which is adapted to the roof-like structure of the current collector. As a result of this structure the collectors 9–12 are vaulted around the duty system. The current collectors may be arcuate in cross section or as shown in FIG. 1, of angular form.

The beam passage openings 4 and 5 are provided with further recesses 24 which receive the freely suspended peaks 14 of the current collectors mounted on the opposite end wall, the recesses 24 alternating in the circumferential direction with the mounting points 23 of the current collectors. The openings 4 and 5 of the walls 2 and 3 are angularly displaced with respect to each other in axial symmetry, the mutual angular displacement angle being 90° in the case of four current collectors.

The electrodes, or duty system, 8 are connected by electrode connectors 16 to the current collectors 9 to 12 in a mechanically stable and electrically conducting manner, thus forming two intersecting partial systems which are not in direct contact with each other. One partial system is connected to one end wall 2 of the cylindrical resonator housing 1 by the wide ends of the current collectors 9 and 11, and the other partial system is connected to the other end wall 3 of the cylindrical housing 1 by the wide ends of the current collectors 10 and 12. The end walls 2 and 3 of the resonator housing are in turn connected together by the metallic cylinder jacket 1 which in general may also form the vacuum vessel of a linear accelerator.

The openings 4 and 5 in the end walls, or front cylinder covers, 2 and 3 are shaped to conform to the combined partial systems. First, this facilitates installation, since the electrode and connector system as a whole may be moved into the resonator housing 1, and then be mounted to the end walls 2 and 3. Second, neighboring resonators of a longer linear accelerator may be closely coupled with each other via the openings 4 and 5. For that purpose, the wide ends of the current collectors 9 to 12 of neighboring resonators are connected with each other, and so are the narrow ends or peaks 14.

The effective power for excitation of the resonators and for the acceleration of the particle beam 6 is thus passed over from resonator to resonator and has to be coupled into the accelerator only once, or just at a few points. Furthermore, continuous, versatilely usable supports for the connections of the duty system are formed, the arrangement of the duty system thus not requiring any special positioning of the end walls. Finally, the duty system voltages in neighboring resonators will of necessity be identical. This possibility of coupling single resonators is therefore an especially important feature of the present invention.

The thin ends or peaks 14 of the current collectors 9 to 12 may experience free electric oscillations, these being in phase opposition in the fundamental mode of the resonator in antiphase. An important feature of embodiments of the invention is that the amplitude of the oscillations, measured with respect to the outer cylinder 1, increases linearly with the distance from the respective broad end of each collector, and not sinusoidally. Thereby, the voltage difference between adjacent collectors is everywhere constant and equal to the voltage U induced by the time variation of the main magnetic flux Φ.

This condition can be explained as follows:

If the voltage was nonuniform, this nonuniformity would have had to be induced by parts of the magnetic flux traversing the system between the current collectors. But the equidistribution of the current densities on the collector surfaces does not allow such transversal fluxes. The equidistribution of the current density on the collector surfaces might, on the other hand, only be disturbed by additional capacitive currents drawn out of the cylinder jacket, as they usually appear in TEM coaxial resonators. These are thereby suppressed in that in every length element of the resonator the sum of the area parts of the inner conductor multiplied by the voltages thereon equals zero. Also here the special roof peak-like shape of the current collectors is effective. Without this form, a good voltage uniformity cannot be achieved. Measurements on models of the resonator have confirmed this good uniformity.

Figure 2:
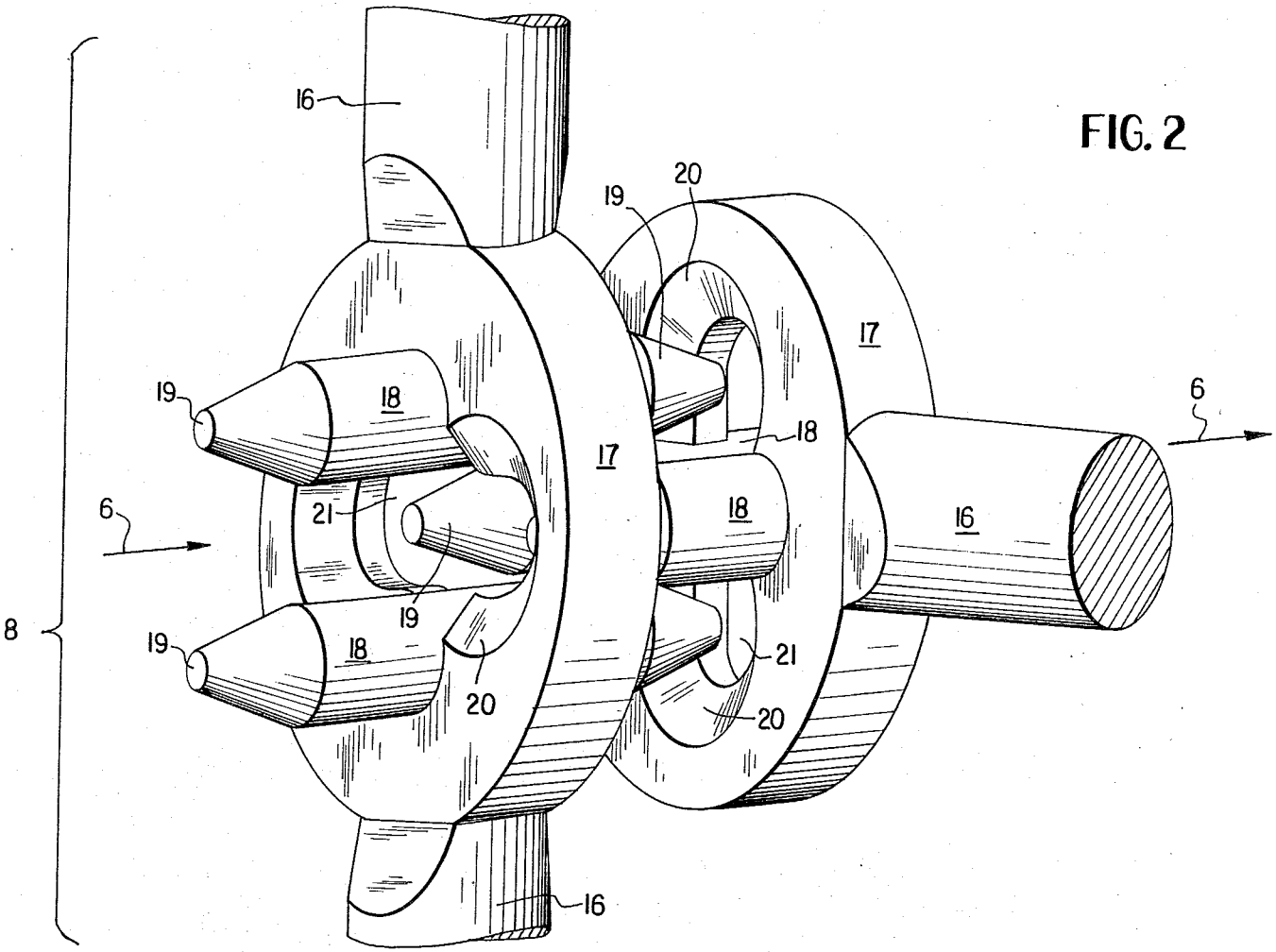
FIG. 2 is a perspective detail view of a portion of the structure of FIG. 1, to an enlarged scale.

A portion of an embodiment of the resonator duty system is shown in perspective and to an enlarged scale in FIG. 2. In this embodiment, the electrode duty system 8 consists of a succession of annular drift tubes 17 each having four focussing fingers 18. The focussing fingers 18 carried by each tube 17 are coaxial with two lines equispaced from the axis of the beam and lying in a common plane with that axis, with two fingers extending along each line and projecting from respectively opposite end faces of their associated tube 17. Thus, the fingers carried by each tube 17 are composed of two pairs, with each pair projecting axially in a respectively opposite direction and the fingers of each pair being disposed diametrically opposite one another with respect to the axis of beam 6. At their free ends, the focussing fingers 18 are provided with tapered peaks 19 projecting into lateral recesses 20 of the openings 21 in longitudinally adjacent drift tubes 17, but while being out of contact with the adjacent drift tubes and their associated focussing fingers. The fingers 18 carried by each tube 17 are angularly offset by 90° about the axis of beam 6 from the fingers carried by longitudinally adjacent tubes. Each drift tube 17 is, by means of a pair of diametrically opposed electrode connectors 16, conductingly connected, or, seen from the direction of the beam, attached, to a respective pair of current collectors 9 and 11 or 10 and 12 as shown in FIG. 1. Here again the connectors 16 supporting each tube 17 are angularly offset by 90° about the axis of beam 6 from the connectors supporting the longitudinally adjacent tubes 17. The connectors 16 of successive drift tubes 17 are connected to respectively alternate pairs 9 and 11 or 10 and 12 of the current collectors so that each pair of current collectors is connected to every other drift tube.

A specific example as shown in the FIGS. 1 and 2 has been designed to accelerate ions from 0,0075 to 0,0095 of the velocity of light. The frequency of the linac should be 13,5 MHz. The average drift tube spacing is about 9 cm. The proper length of the cavity is 2.00 m, that is one 11th part of the free space wavelength of the r.f. wave; this cavity contains 21 drift tubes. Each drift tube supports two focusing fingers, varying in length from 15.3 to 17.6 cm, and the clear aperture for the beam is 2,4 cm wide. The electric capacity of the duty system, including the mutual capacity of the conductors is C=280 pF, and the capacity per length unit is C'=140 pF/m.

The cross section of the current conductor assembly is an octangle made up of four short sides, 6 cm each, and four long sides 23.51 cm each. A part of 6.4 cm of the longer sides is taken by the gap. The individual current conductors are made up of copper sheets and have a shape as indicated in FIG. 1. A ridge of 6 cm width is running all along the conductor. The side parts of the conductors are right triangles with side lengths of 17.1 cm and 2 m. To meet the proper frequency of 13.5 MHz, the clear radius $r_a$ of the outer conductor has to be 63 cm, if the thickness of the end walls is 8 cm. The inner radius $r_i$ of the cavity is 19 cm.

It is to be understood that the above description of the present invention is susceptible to various modifications, changes and adaptations, and the same are intended to be comprehended within the meaning and range of equivalents of the appended claims.

What is claimed is:

1. In a high frequency resonator for accelerating a beam of heavy ions in an accelerator, which resonator includes a cylindrical resonator housing having a beam inlet end via which the beam enters the housing, a beam outlet end via which the beam leaves the housing and a longitudinal axis defining a path for travel of the beam between the ends, means defining first and second opposed end walls each at a respective end of the housing, and an even number of elongate, conductive current collectors disposed within the housing, extending longitudinally thereof, and spaced apart equidistantly about the beam axis, with every other collector being connected to said first end wall and the intervening collectors being connected to said second end wall, the number of such collectors being at least four, the improvement wherein:

each said end wall is provided with a central opening surrounding the longitudinal axis of said housing;

each said current collector extends the full length of said housing;

each said collector has two longitudinal ends, one longitudinal end of each collector extends into said opening of that end wall to which that said collector is connected and the other longitudinal end of each collector extends into said opening of the other said end wall while being out of contact with the other said end wall; and each said collector has a width in a direction transverse to its longitudinal extent, and the width of each collector decreases, along its longitudinal extent, from a maximum width at its said one longitudinal end to a minimum width at its said other longitudinal end in a manner to establish an at least approximately uniform current density on the surface of each said collector.

2. An arrangement as defined in claim 1 wherein each said collector has a transverse profile at least at its one longitudinal end, said central opening of each said end wall has a border including two portions, each said border portion is configured to mate with the transverse profile of said one longitudinal end of a respective one of said collectors which is connected to the associated end wall, and said one longitudinal end of each said collector is connected to its associated end wall via a respective one of said border portions of said central opening of its associated end wall.

3. An arrangement as defined in claim 1 wherein each said collector has, in a direction perpendicular to its length, a vault-like form opening toward the longitudinal axis of said housing.

4. An arrangement as defined in claim 2 wherein each said opening is provided with recesses alternating around the circumference of said opening with said border portions at which collectors are connected, and said other longitudinal end of each said collector projects into a respective recess of said opening in that said end wall with which that said other collector end is associated.

5. An arrangement as defined in claim 1 further comprising a plurality of annular drift tubes each presenting an opening traversed by the beam axis, said tubes being spaced apart along that axis, means conductively connecting every other one of said tubes to those of said collectors which are connected to said one end wall, and means conductively connecting the remaining ones of said drift tubes to those of said collectors which are connected to said other end wall.

6. An arrangement as defined in claim 5 further comprising beam focussing means carried by said drift tubes and surrounding the beam axis.

7. An arrangement as defined in claim 6 wherein said focussing means comprise two pairs of focussing fingers carried by each said drift tube and each extending parallel to th beam axis, with each pair of fingers projecting toward a respective immediately adjacent drift tube and the fingers of each said pair being located diametrically opposite one another relative to the beam axis, and wherein said fingers carried by each said drift tube are angularly offset by 90° about the beam axis relative to said fingers carried by the immediately adjacent drift tube.

8. An arrangement as defined in claim 7 wherein, for each respective drift tube, said opening includes a plurality of recesses each axially aligned with a respective finger projecting toward said respective drift tube from an immediately adjacent drift tube, and each said finger has a tapered end extending into that recess with which said finger is axially aligned while being out of contact with that said drift tube toward which said finger projects.

9. An arrangement as defined in claim 1 wherein each said collector has, in a direction perpendicular to its length, the form of an arch opening toward the longitudinal axis of said housing.

10. An arrangement as defined in claim 1 wherein each said collector has, in a direction perpendicular to its length, the general form of a roof peak opening toward the longitudinal axis of said housing.

* * * * *